US011543167B2

(12) United States Patent
Mitchell

(10) Patent No.: US 11,543,167 B2
(45) Date of Patent: Jan. 3, 2023

(54) APPLIANCE ICE MAKING ASSEMBLY

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 12 days.

(21) Appl. No.: 17/220,249

(22) Filed: Apr. 1, 2021

(65) Prior Publication Data

US 2022/0316782 A1 Oct. 6, 2022

(51) Int. Cl.
*F25C 5/06* (2006.01)
*F25C 5/20* (2018.01)

(52) U.S. Cl.
CPC ..... *F25C 5/06* (2013.01); *F25C 5/22* (2018.01); *F25C 2305/022* (2013.01); *F25C 2400/10* (2013.01)

(58) Field of Classification Search
CPC .. F25C 5/22; F25C 2305/522; F25C 2400/10; F25C 2400/08
See application file for complete search history.

(56) References Cited

U.S. PATENT DOCUMENTS

| | | | | |
|---|---|---|---|---|
| 9,234,689 | B2 | 1/2016 | Dongjeong | |
| 9,696,079 | B2 | 7/2017 | Boarman | |
| 2010/0218542 | A1* | 9/2010 | McCollough | F25D 21/14 700/275 |
| 2013/0014535 | A1* | 1/2013 | Son | F25C 1/10 62/340 |
| 2014/0165621 | A1* | 6/2014 | Boarman | F25C 1/10 62/344 |
| 2020/0158413 | A1* | 5/2020 | Kim | F25C 1/10 |

FOREIGN PATENT DOCUMENTS

| | | | |
|---|---|---|---|
| ES | 26884 | U | 6/1951 |
| JP | H0689970 | B | 11/1994 |

* cited by examiner

*Primary Examiner* — Elizabeth J Martin
(74) *Attorney, Agent, or Firm* — Dority & Manning, P.A.

(57) ABSTRACT

An ice making assembly for a refrigerated appliance can include a mold defining a chamber for the formation of an ice shape, the mold rotatable between a first position and a second position. An ejector may be positioned adjacent to the mold and is rotatable with the mold between the first position and the second position. The ejector can be configured to push the ice shape out of the chamber through an opening as the mold rotates between the first position and the second position.

17 Claims, 11 Drawing Sheets

APPLIANCE ICE MAKING ASSEMBLY

FIELD OF THE INVENTION

The subject matter of the present disclosure relates generally to an appliance for making ice, particularly larger ice pieces.

BACKGROUND OF THE INVENTION

Ice makers are commonly provided as stand-alone appliances or may be incorporated within larger refrigerated appliances used to store food items in both commercial and residential applications. Typically, such ice makers are configured for the bulk production of ice where e.g., multiple pieces of ice are used to cool the same beverage or used to cool other food items. The individual pieces of ice may have different shapes and are typically relatively smaller in size (e.g., largest dimension of an individual piece might be 2 inches or less, or even 1 inch or less). These bulk ice makers typically do not create multiple, larger pieces or pieces of ice and some do not create pieces that are uniformly of a particular shape such as spherical.

Some consumers may prefer a particular size or shape of ice for certain beverages. For example, in the consumption of some alcohol-based drinks, consumers may prefer to use a single piece of ice in the shape of sphere for cooling the beverage. Where a glass or metal cup is used, a spherical ice cube having a diameter nearly as large as the opening of the cup may also be preferred. A diameter of e.g., two inches or more may be preferred. While other shapes may also be utilized, a single piece of ice in a spherical shape may melt more slowly that other shapes or multiple pieces of ice, which can mean less dilution of the alcohol-based drink. In addition, certain consumers may also prefer ice that is relatively clear or transparent.

Manually-filled ice molds in particular shapes and sizes are available. These molds may be one or multiple pieces. The consumer manually fills the mold with water and may also have to remove entrapped air. The mold is then placed into a refrigerated space maintained at freezing temperatures. The mold is later removed after enough time has elapsed to freeze the water. The mold may have to be slightly heated and/or flexed to cause the ice to be released from the mold. The process must be manually repeated if the consumer wants additional ice. Drawbacks to the manual process may include spills, difficulties in removing ice from the mold, the rate of ice piece production is limited by the number of molds, and the user must remember to refill the molds each time.

Accordingly, an ice maker that can automatically or repeatedly make larger pieces of ice in a particular shape would be desirable. Such an ice maker that can be used in an appliance dedicated to ice making or readily incorporated into a refrigerated appliance would be particularly beneficial. Such an ice maker that may also be used to manufacture clear or transparent ice would also be desirable.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides an ice making assembly for a refrigerated appliance. The assembly includes a mold defining a chamber for the formation of an ice shape and an opening, where the mold rotatable between a first position and a second position. An ejector may be positioned adjacent to the mold and is rotatable with the mold between the first position and the second position. The ejector can be configured to push the ice shape out of the chamber through the opening as the mold rotates between the first position and the second position. A motor provides for rotating the mold and the ejector from the first position to the second position.

In another exemplary embodiment, the present invention can provide a cabinet including a freezer chamber. An ice making assembly may be positioned in the freezer chamber. A flexible mold defines a chamber for the formation of an ice shape and an opening to the chamber. The mold can be configured to rotate between a first position in which the opening is oriented upwardly and a second position in which the ice shape can be ejected from the chamber. An ejector is positioned adjacent to the mold. The ejector may be configured to extend between i) a retracted position when the flexible mold is in the first position and ii) an extended position when the flexible mold is in the second position. The ejector causes the ice shape to move through the opening of the chamber as the ejector moves from the retracted position to the extended position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a perspective view of an exemplary ice making assembly of the present invention while

FIG. 12 depicts a portion of the exemplary ice making assembly in the first position while

The use of the same similar reference numbers in the figures denotes the same or similar features unless the context indicates otherwise.

DETAILED DESCRIPTION OF THE INVENTION

Figure 1:
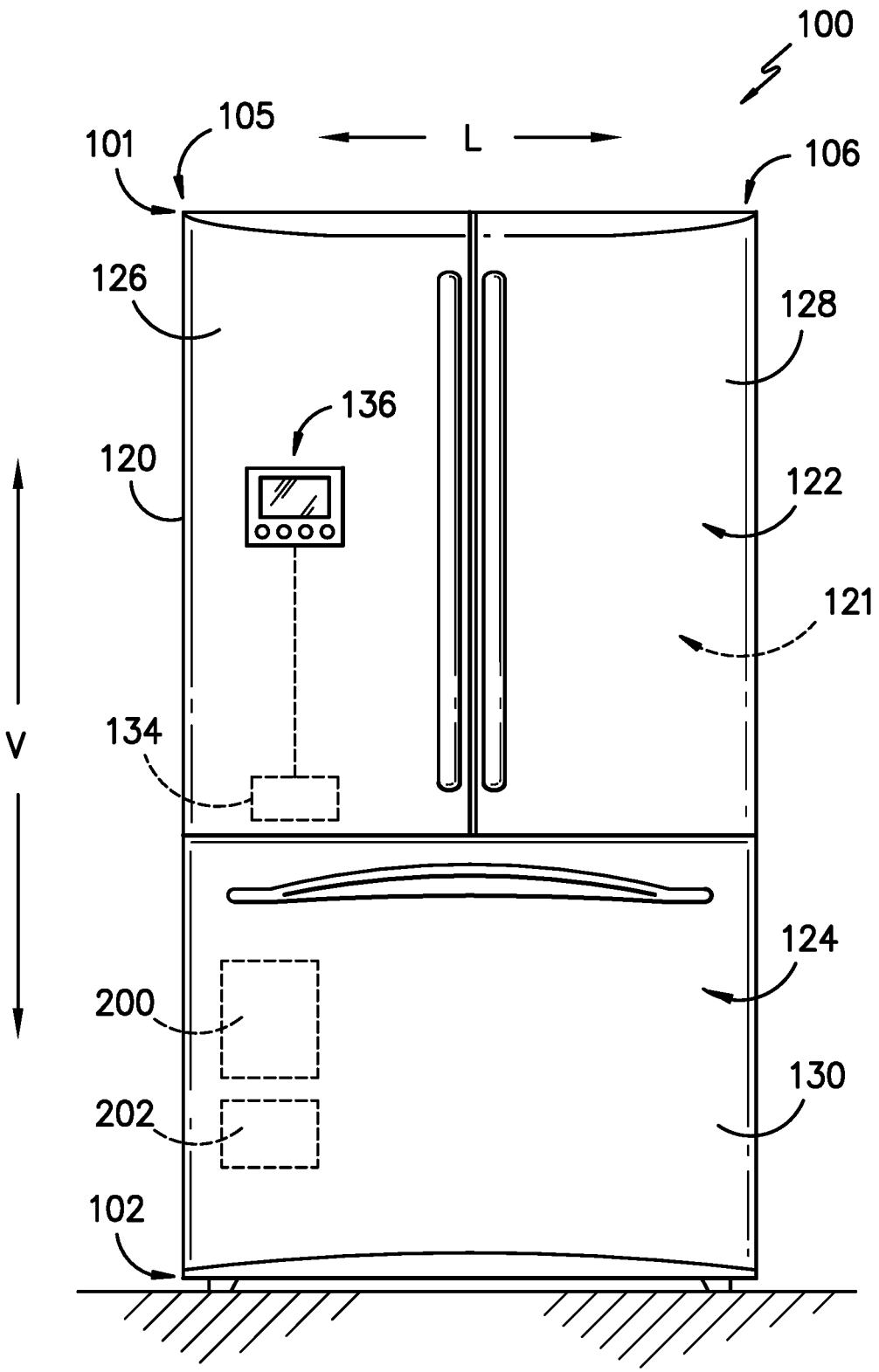
FIG. 1 provides a front view of an exemplary appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an exemplary embodiment of the present subject matter. Refrigerator appliance 100 extends between a top 101 and a bottom 102 along a vertical direction V. Refrigerator appliance 100 also extends between a first side 105 and a second side 106 along a lateral direction L. A transverse direction T (FIG. 2) is defined perpendicular to the vertical and lateral directions V, L. Accordingly, vertical direction V, lateral direction L, and transverse direction T are mutually perpendicular and form an orthogonal direction system.

Refrigerator appliance 100 includes a housing or cabinet 120 defining an interior volume 121. Cabinet 120 also defines an upper fresh food chamber 122 and a lower freezer chamber 124 arranged below the fresh food chamber 122 on the vertical direction V. As such, refrigerator appliance 100 is generally referred to as a bottom mount refrigerator. In this exemplary embodiment, cabinet 120 also defines a mechanical compartment (not shown) for receipt of a sealed cooling system (not shown). It will be appreciated that the present subject matter can be used with other types of refrigerators (e.g., side-by-sides), freezer appliances, other types of appliances, and/or any other suitable shelving system. The present subject matter may also be used with a dedicated ice-making appliance—i.e. an appliance that only makes larger ice pieces as described herein. Consequently, the description set forth herein is for exemplary purposes only and is not intended to limit the scope of the present subject matter in any aspect.

Refrigerator appliance 100 includes refrigerator doors 126, 128 that are rotatably hinged to an edge of cabinet 120 for accessing fresh food chamber 122. It should be noted that while doors 126, 128 are depicted in a "french door" configuration, any suitable arrangement or number of doors is within the scope and spirit of the present subject matter. A freezer door 130 is arranged below refrigerator doors 126, 128 for accessing freezer chamber 124.

Operation of refrigerator appliance 100 can be regulated by a controller 134 that is operatively coupled to a user interface panel 136. Panel 136 provides selections for user manipulation of the operation of refrigerator appliance 100 such as e.g., interior shelf lighting settings. In response to user manipulation of user interface panel 136, controller 134 operates various components of refrigerator appliance 100. Controller 134 may include a memory and one or more processors, microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 134 may be positioned in a variety of locations throughout refrigerator appliance 100. In the illustrated embodiment, controller 134 is located within door 126. In such an embodiment, input/output ("I/O") signals may be routed between the controller and various operational components of refrigerator appliance 100. In one embodiment, user interface panel 136 may represent a general purpose I/O ("GPIO") device or functional block. The user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. The user interface 136 may be in communication with controller 134 via one or more signal lines or shared communication busses.

Figure 2:
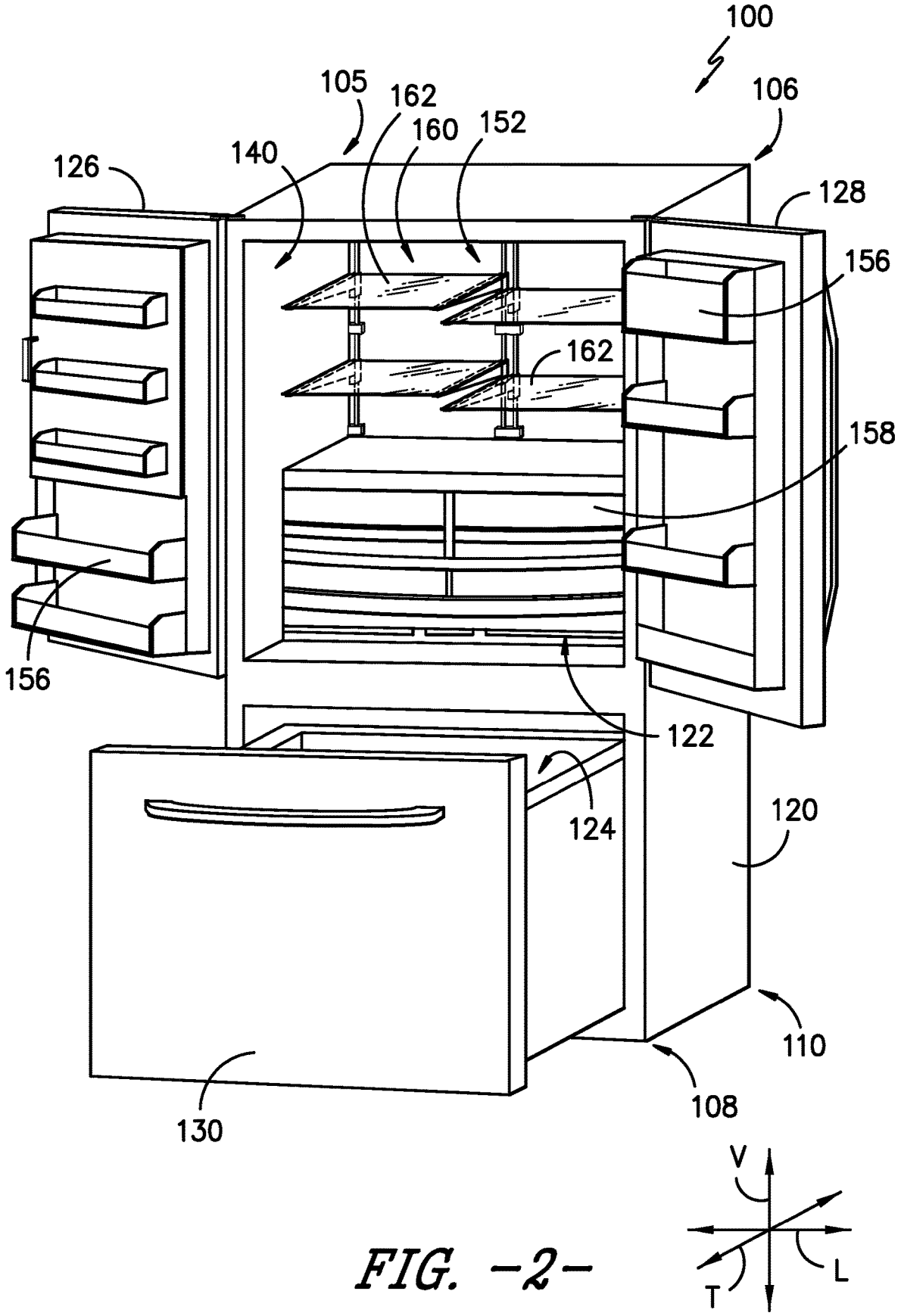
FIG. 2 provides a perspective view of the exemplary appliance of FIG. 1, with certain doors and a drawer shown in an open position to reveal the interior of the appliance.
Figure 3:
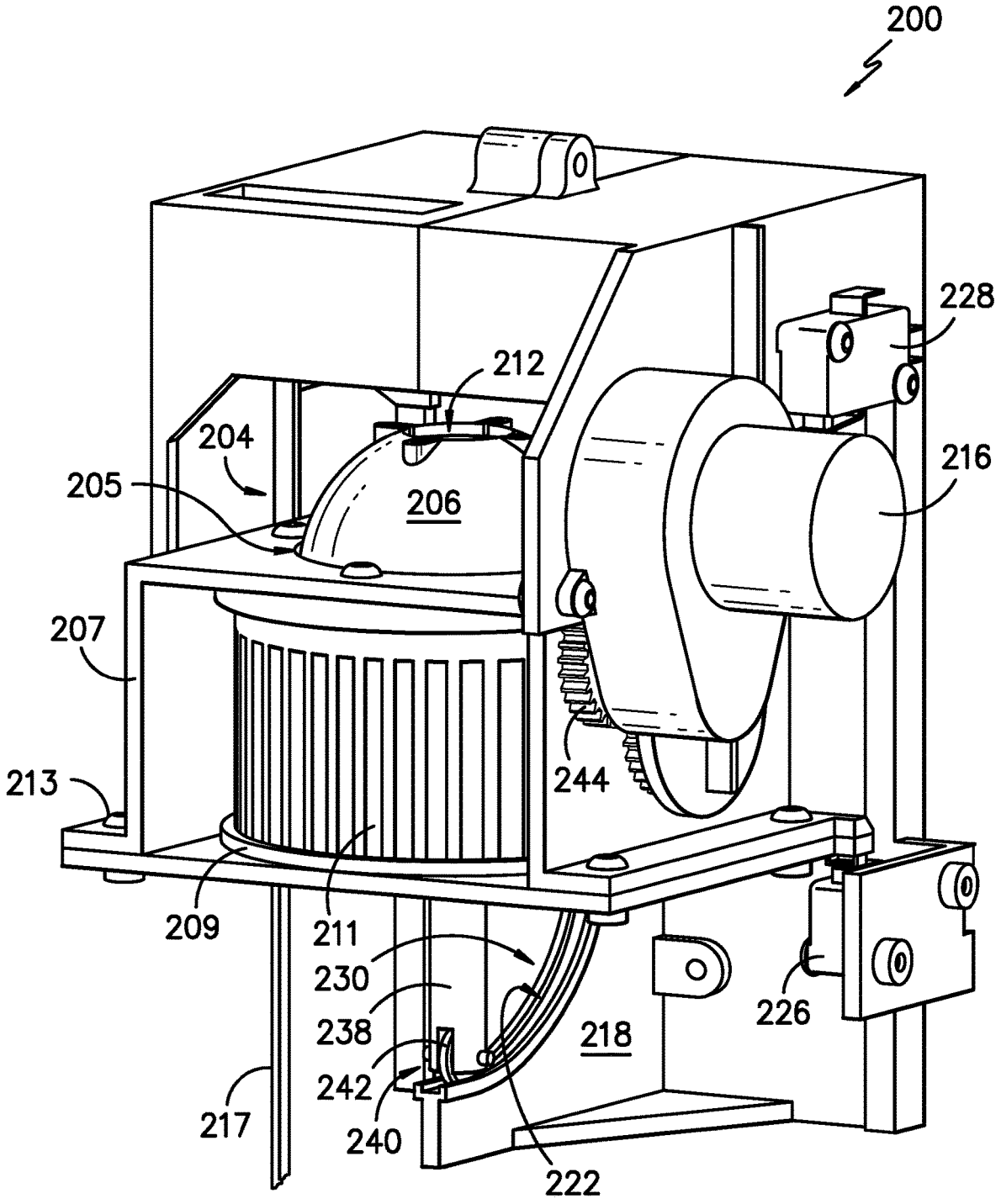
Figure 4:
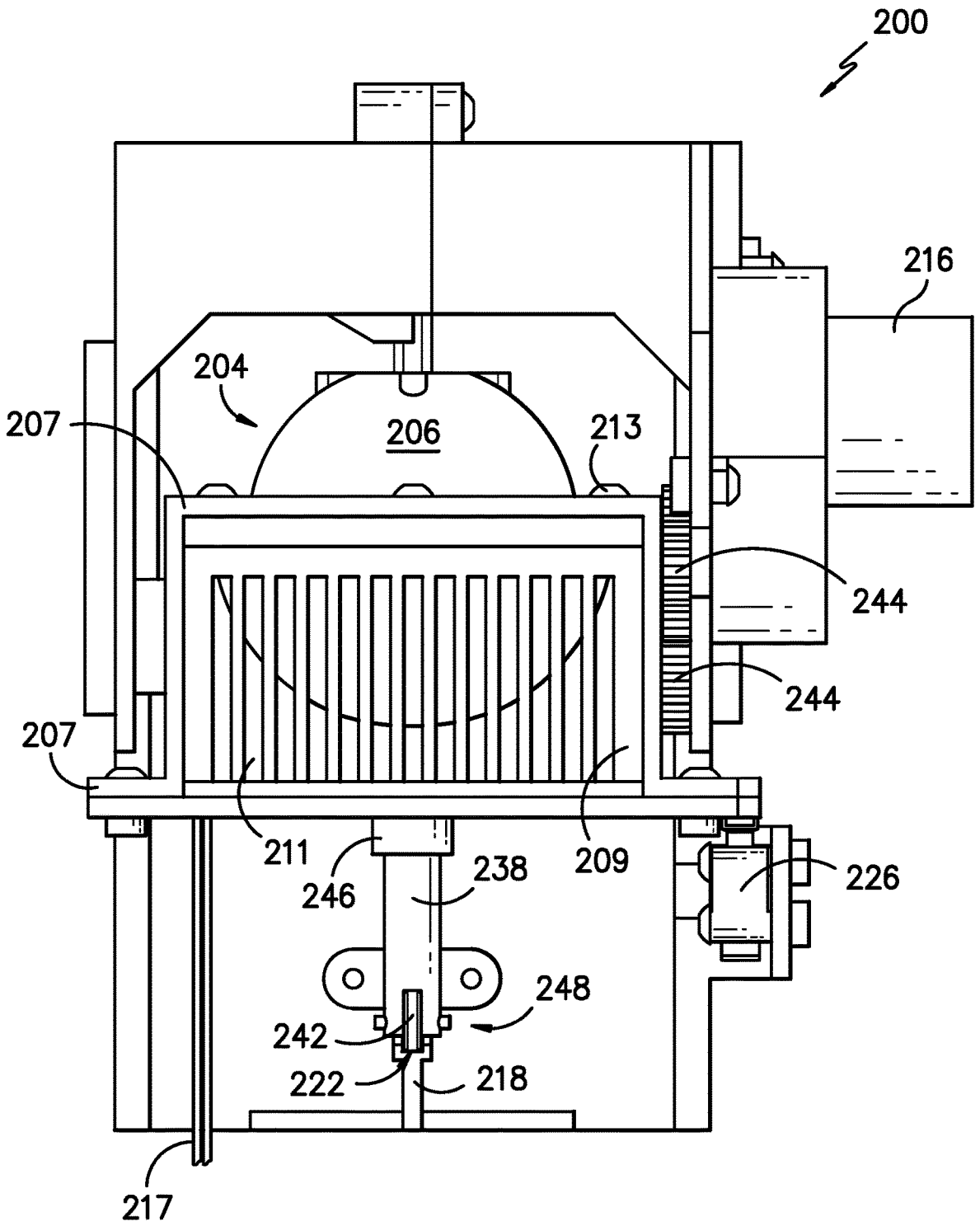
FIG. 4 is a side view thereof.

FIG. 2 provides a front, perspective view of refrigerator appliance 100 having refrigerator doors 126, 128 in an open position to reveal the interior of fresh food chamber 122. Additionally, freezer door 130 is shown in an open position to reveal the interior of freezer chamber 124. As shown more clearly in FIG. 2, refrigerator appliance 100 extends in the transverse direction T between a front end 108 and a rear end 110.

As shown in FIG. 2, for this exemplary embodiment, fresh food chamber 122 of refrigerator appliance 100 includes a shelving assembly 160 mounted to a rear wall 152 of cabinet 120. More specifically, exemplary shelving system 160 includes two columns of shelves 162 spaced apart generally along the vertical direction V. It should be appreciated that refrigerator appliance 100 may include any suitable number of shelves 162 in any suitable position or configuration. For example, in alternative embodiments, shelving assembly 160 could also include shelves 162 mounted to, or supported upon, another surface within the interior of cabinet 120, such as to one of both of the opposing sidewalls 140 of cabinet 120 or in the freezer chamber 124. For example, shelves 162 could be configured in a single column of shelves supported on both opposing sidewalls 140 or a combination of sidewalls 140 and rear wall 152. Other configurations for shelving assembly 160 may be use as well including adjustable shelving systems. For this embodiment, appliance 100 also includes various shelves 162, drawers 158, and can include other compartments as will be understood by one or ordinary skill in the art.

FIGS. 3 through 14 illustrate an exemplary embodiment of an ice making assembly 200 as may used in refrigerator appliance 100 or another appliance configuration (including a dedicated appliance) as previously stated. For example, ice making assembly 200 may be located in lower freezer chamber 124 as shown in FIG. 1. An ice bin 202 may be included for the collection of ice.

Ice making assembly 200 includes a mold 204 that defines a chamber 210 for the making of an ice shape 234 or i.e. a single ice piece 234 of a predetermined shape. For this exemplary embodiment, ice shape 234 is spherical but a mold 204 providing a chamber 210 for other shapes may be used as well. In one exemplary aspect of the invention, ice shape 234 has a diameter or largest dimension of 2 inches, 3 inches, or larger. Other sizes may also be created.

In this exemplary embodiment, mold 204 is constructed from an upper mold half 206 and a lower mold half 208 (FIG. 5) contained within an upper mold shell 207 and a lower mold shell 209. The two mold halves 206 and 208 are pressed together between upper mold shell 207 and lower mold shell 209 connected by various fasteners 213. Lower mold shell 209 may include a plurality of heat exchanging fins 211 in thermal communication with lower mold half 208 to assist with heat transfer during the freezing process. A thermocouple 215 or other temperature sensor may be connected with controller 134 through wires 217 so that the freezing process can be monitored during ice production. Upper mold shell 207 defines an opening 205 (FIG. 6) through which the upper mold shell 207 extends. Upper mold half 206 defines an opening 212 to chamber 210. Multiple pleats 230 are positioned about the opening 212 and may be uniformly spaced as shown.

Mold halves 206 and 208 are constructed from a flexible or resilient material. In one exemplary aspect, one or both mold halves 206 and 208 are constructed from a silicone rubber. Pleats 230 allow the size or diameter of opening 212 to increase as an ice shape 234 is ejected from the mold as will be further explained. In another exemplary aspect, one or both mold halves 206 and 208 are constructed from a flexible and hydrophobic material such as e.g., silicone rubber. The hydrophobic property assists in precluding water from escaping through pleats 230 during the filling and freezing processes. A unitary construction may also be used instead of mold halves 206 and 208 in other embodiments of the invention.

Figure 11:
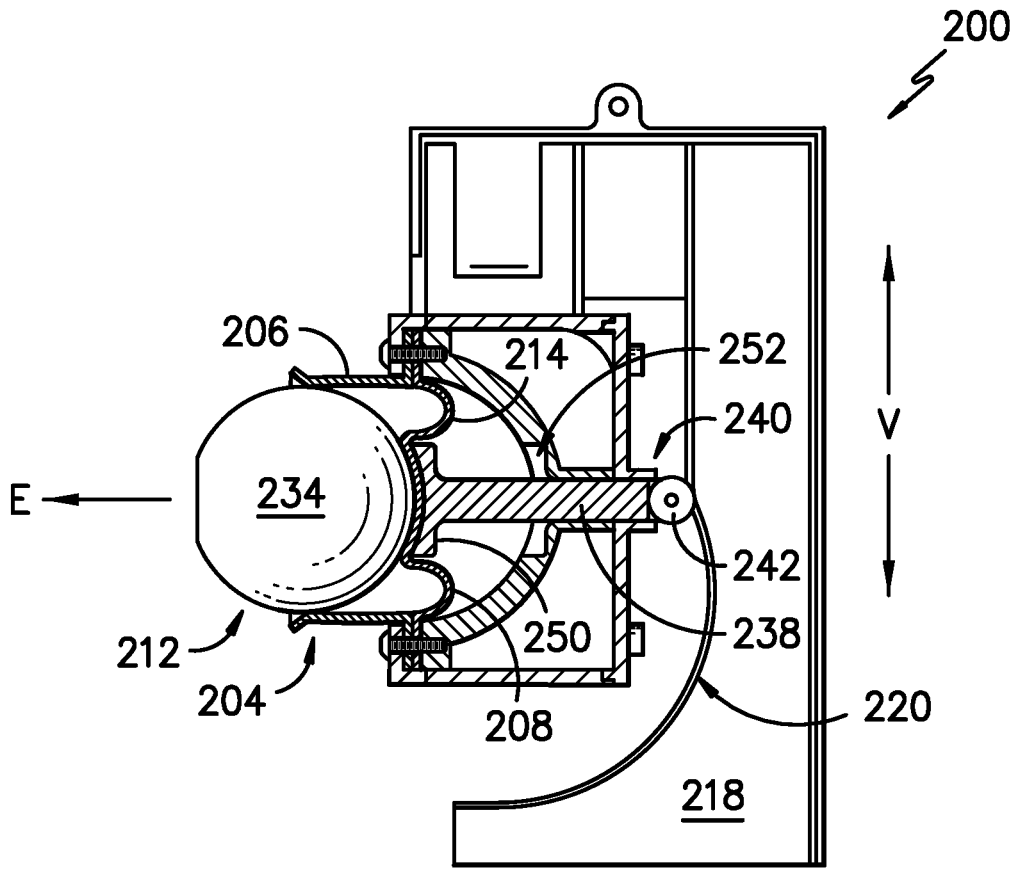
Figure 12:
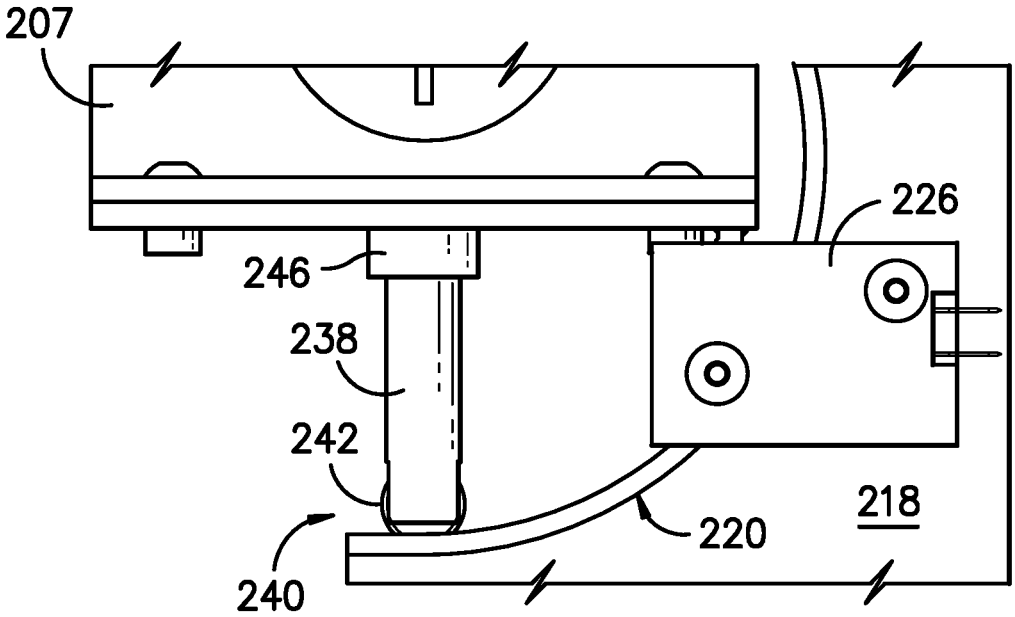
Figure 13:
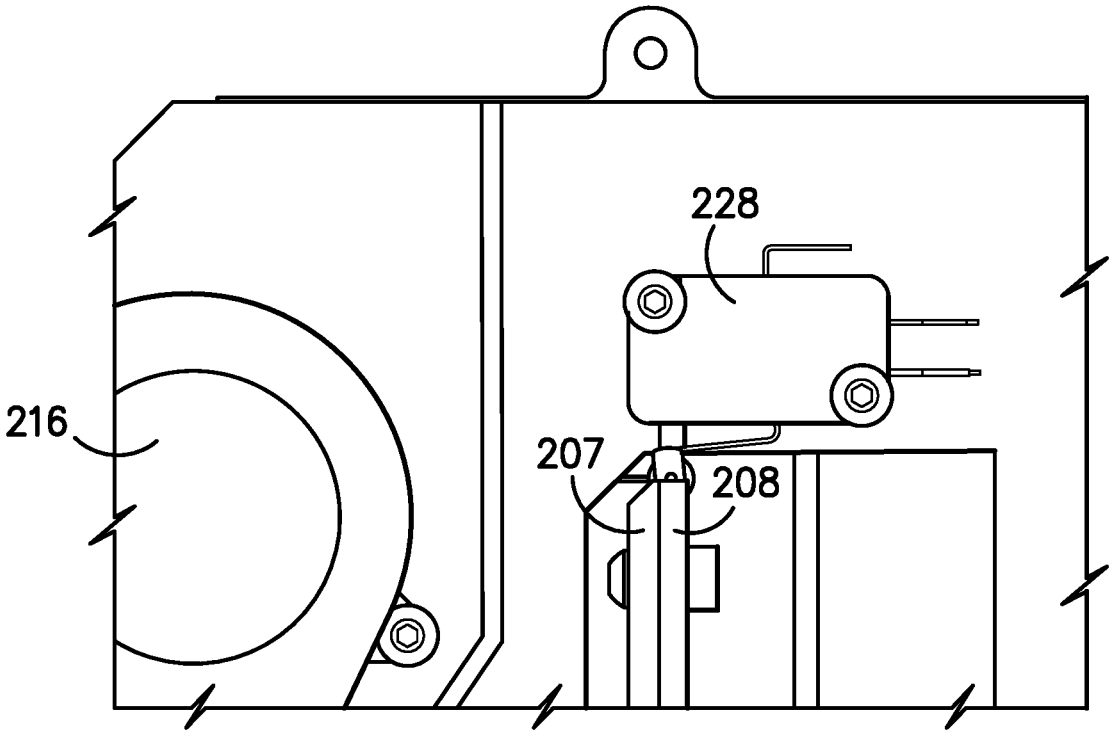
FIG. 13 depicts a portion of the ice making assembly in the second position.
Figure 14:
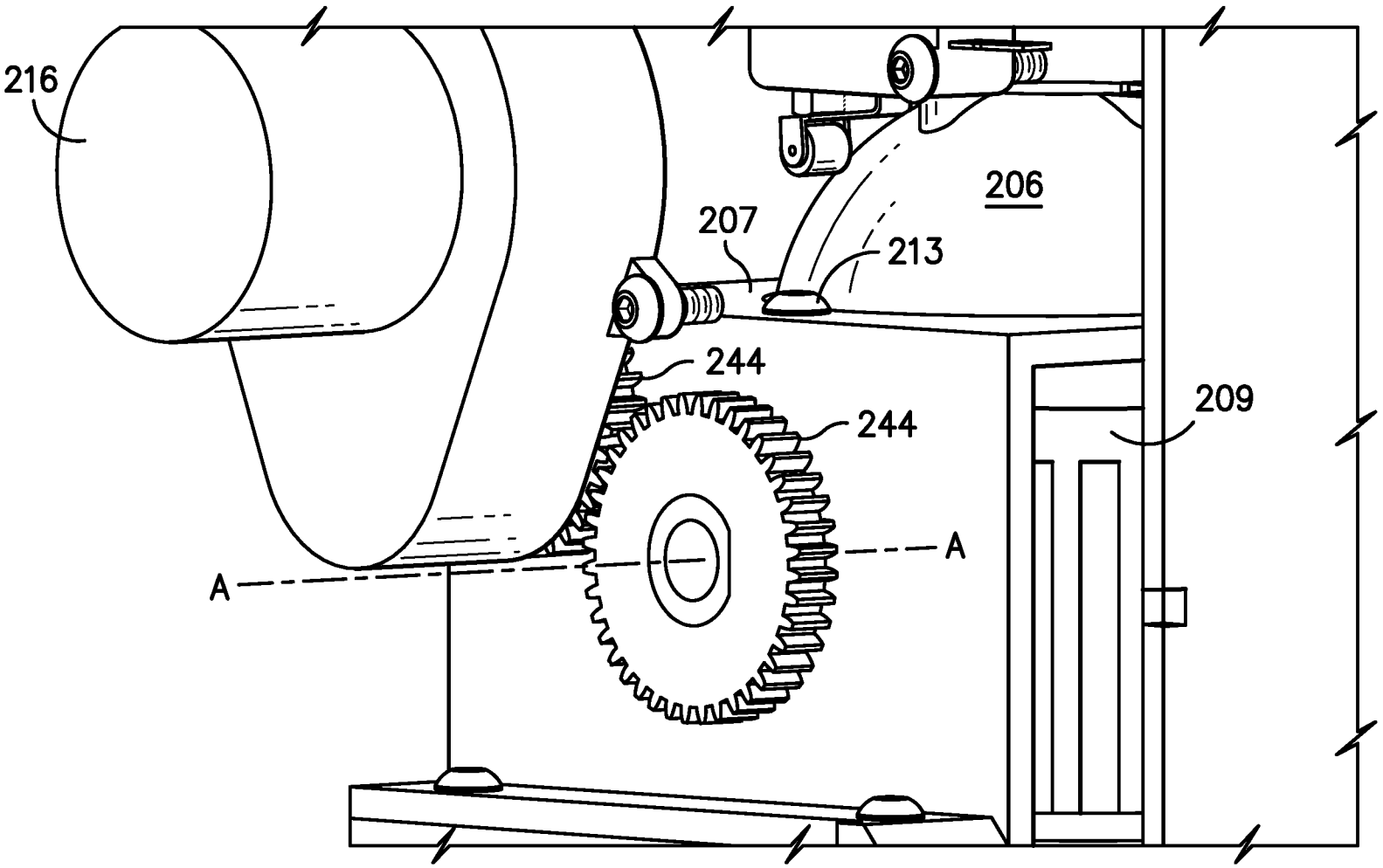
FIG. 14 depicts a close-up view of a portion of the exemplary ice making assembly.

Mold 204 is rotatable between a first position (shown in FIGS. 3, 4, 5, 6, 7, and 12) and a second position (shown in FIGS. 11 and 13). In the first position, mold 204 can be filled within water 236 from a water dispenser 232. For example, a valve (not shown) can be activated by controller 134 as part of an ice making process to provide the appropriate amount of water to flow (arrow F in FIG. 5) into mold 204 when it is in the upper position. As shown in FIG. 12, a first limit switch 226 is contacted by lower mold shell 209 when mold 204 is in the first position. First limit switch 226 can be connected with controller 134 for purposes of determining when mold 204 is in the first position.

In the second position, ice shape 234 is fully ejected from mold 204. Ice shape 234 may be e.g., ejected into ice bin 202. As shown in FIG. 13, a second limit switch 228 is contacted by lower mold shell 209 when mold 204 is in the second position. Second limit switch 228 can be connected with controller 134 for purposes of determining when mold 204 is in the second position. Other configurations of limit switches may also be used to determine the position of mold 204.

A motor 216 operated by controller 134 is used to rotate mold 204 and an ejector 238 between the first and second positions. For example, motor 216 may drive gears 244 so as to rotate mold 204 about axis of rotation A-A between the first and second positions as desired. The direction of rotation of e.g. a shaft (not shown) from motor 216 may be used to control the direction of rotation of gears 244 and therefore mold 204 as determined by controller 134.

Ejector 238 is positioned adjacent to mold 204 and is rotatable with mold 204 between the first position and the second position. As will be explained, the ejector 238 is configured to push ice shape 234 out of chamber 210 through opening 212 during rotation between the first position and the second position. More particularly, ejector 238 is configured to move between a retracted position (shown in FIGS. 3, 4, 5, 6, 7, and 12) and an extended position (shown in FIGS. 11 and 13). Ejector 238 moves from the retracted position to the extended position as mold 204 is moved from the first position to the second position, respectively. While doing so, ejector within a guide or channel 246 formed at least in part by lower mold shell 209.

For this exemplary embodiment, movement of ejector 238 is determined by a cam 218. More particularly, a terminal end 240 of ejector 238 includes a cam follower or wheel 242 that rides in a slot 222 along an arcuate path 220 defined by cam 218. The slotted, arcuate path 220 determines the position of ejector 238 as mold 204 and ejector 238 rotate together from the first position to the second position.

An exemplary method of operating ice making assembly 200 will now be set forth using the described exemplary embodiment. One of skill in the art, using the teachings disclosed herein, will understand that other exemplary methods of operation may be use as well.

Figure 5:
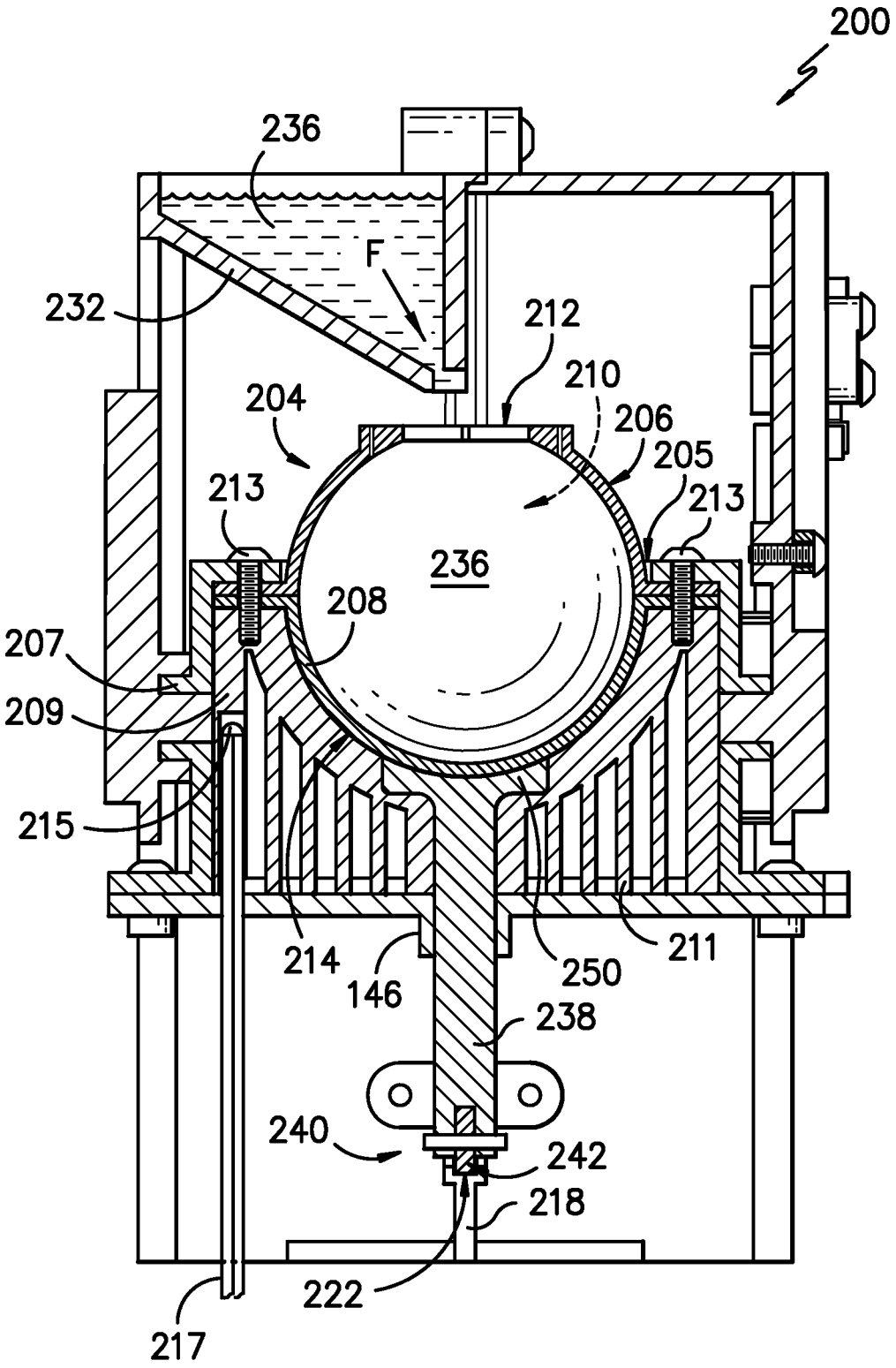
FIG. 5 is a cross-sectional view along a mid-plane of the exemplary ice making assembly of FIGS. 3 and 4.
Figure 6:
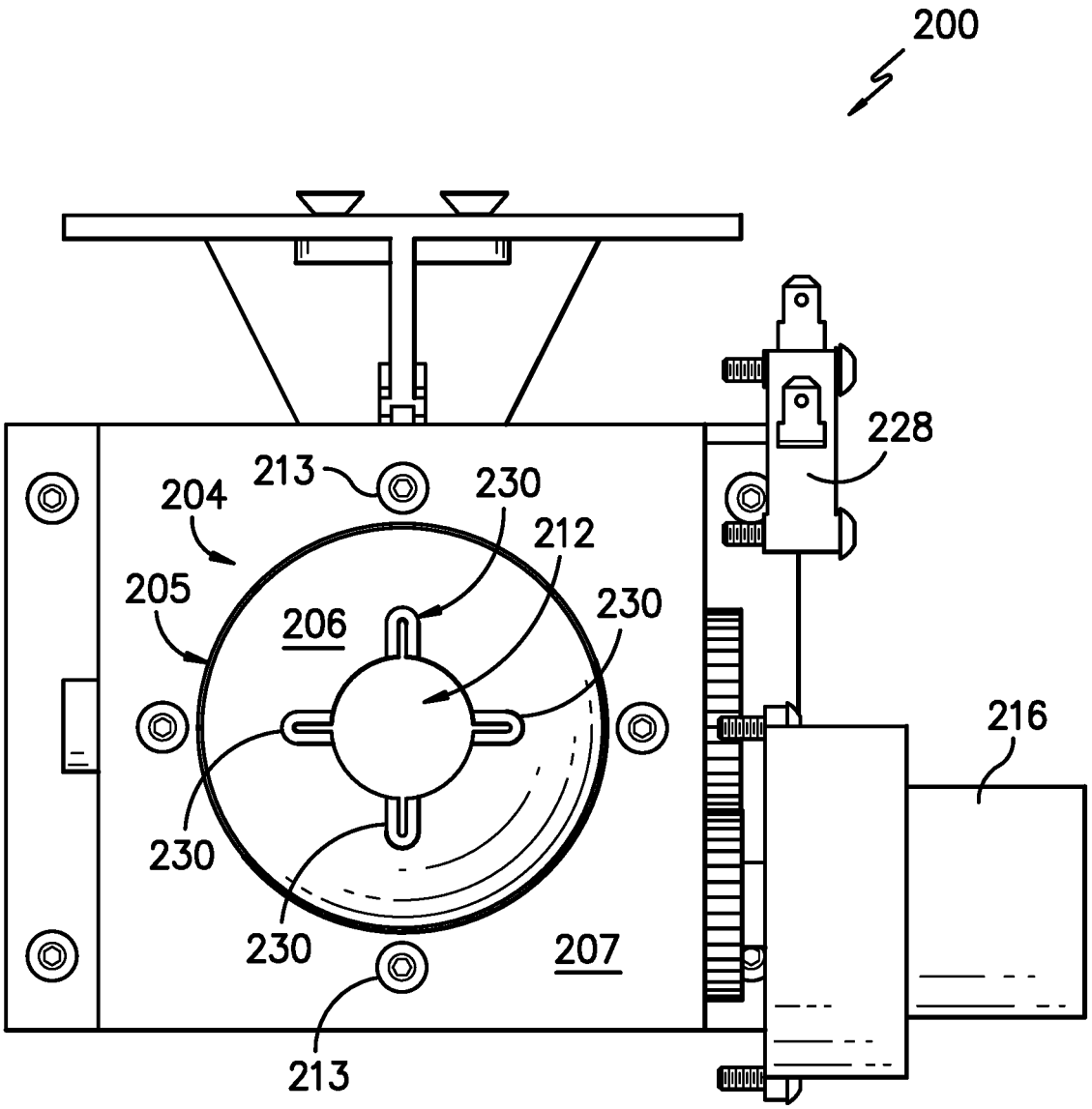
FIG. 6 is a top view of the exemplary ice making assembly.
Figure 7:
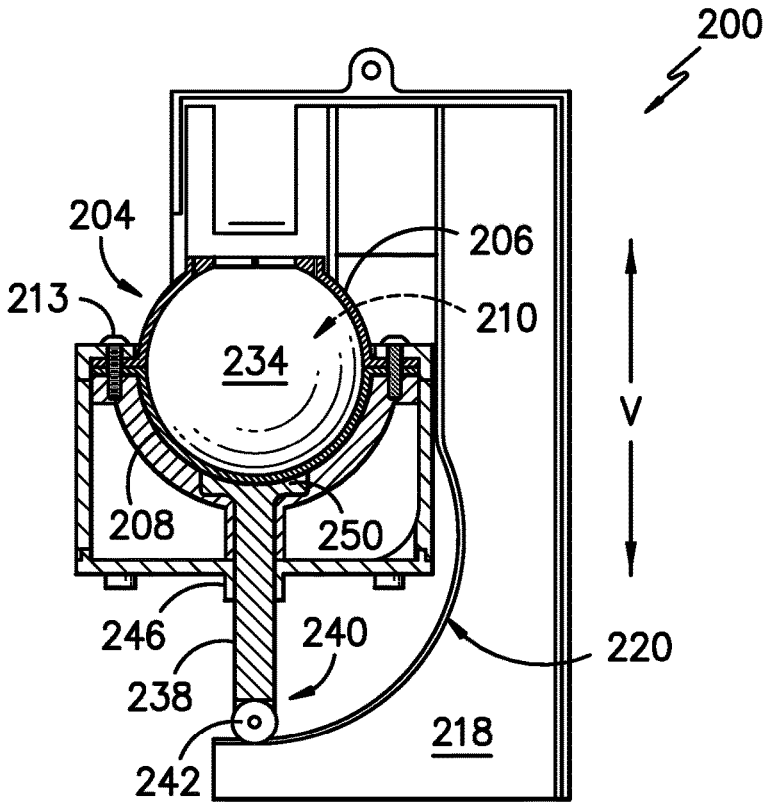
FIGS. 7 through 11 depict the exemplary ice making assembly during rotation between a first position and a second position.

After chamber 210 has been filled with an appropriate amount of water 236 as previously described with reference to FIG. 5, water 236 is allowed to freeze. During the filling and freezing process, mold 204 is maintained in the first position as shown in FIG. 7 during which ejector 238 also remains in the retracted position. In one exemplary aspect of the invention, water 236 may be filtered to remove particulates and may be cooled along a controlled temperature and time profile to provide clearer ice. Temperature (as measured by sensor 215) may be monitored so that e.g., controller 134 may determine when water 236 has been converted into ice shape 234.

Figure 15:
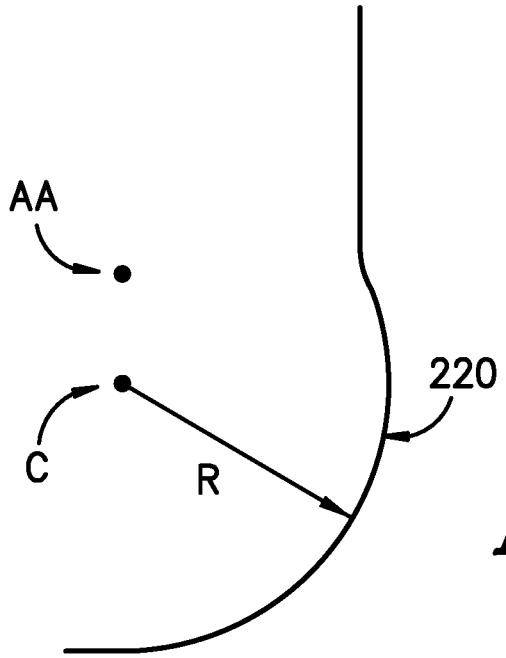
FIG. 15 is a schematic depicting relative locations of the axis of rotation of a mold and the arcuate surface of a cam of the exemplary ice making assembly.

After a determination has been made that water 236 has frozen to form ice shape 234, controller 134 can activate motor 216 to begin rotation of mold 204. As mold 204 rotates about axis of rotation A-A, head 250 of ejector 238 is forced to press against external surface 214 of lower mold half 208. As mold 204 rotates, ejector 238 moves through guide 246 along a direction perpendicular to axis of rotation A-A. Rotation forces ejector 238 to so move because cam follower 242 is riding on acuate path 220. Referring to FIG. 15, a center C of a radius R defining arcuate path 220 is offset by a distance D from the axis of rotation A-A. As such, rotation shortens the distance between guide 246 and the arcuate path 220 of cam 218—forcing ejector 238 to move therethrough.

Figure 8:
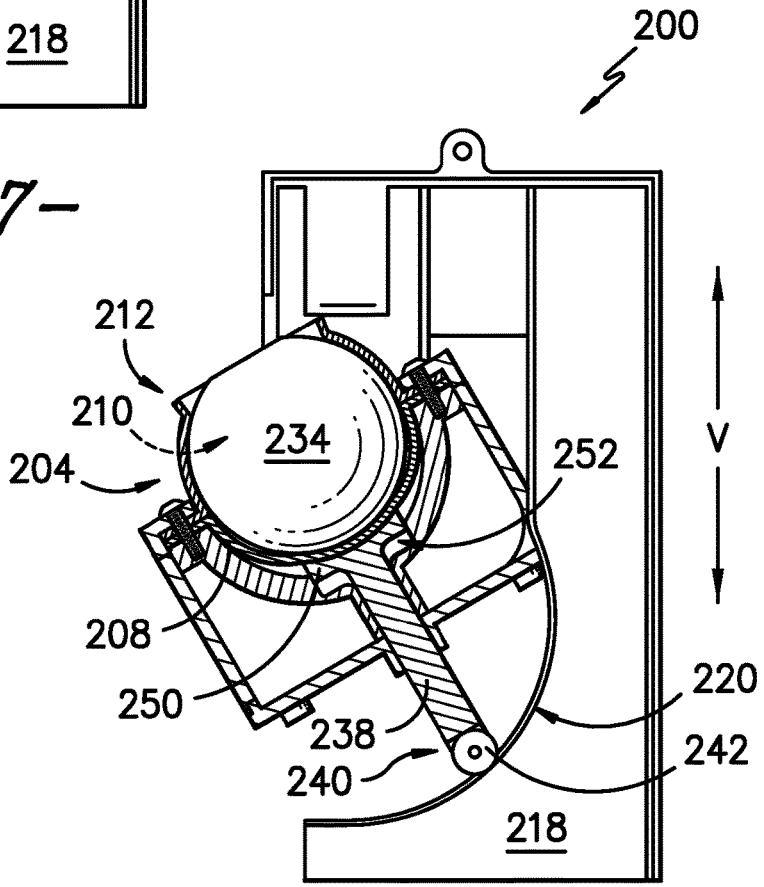
Figure 9:
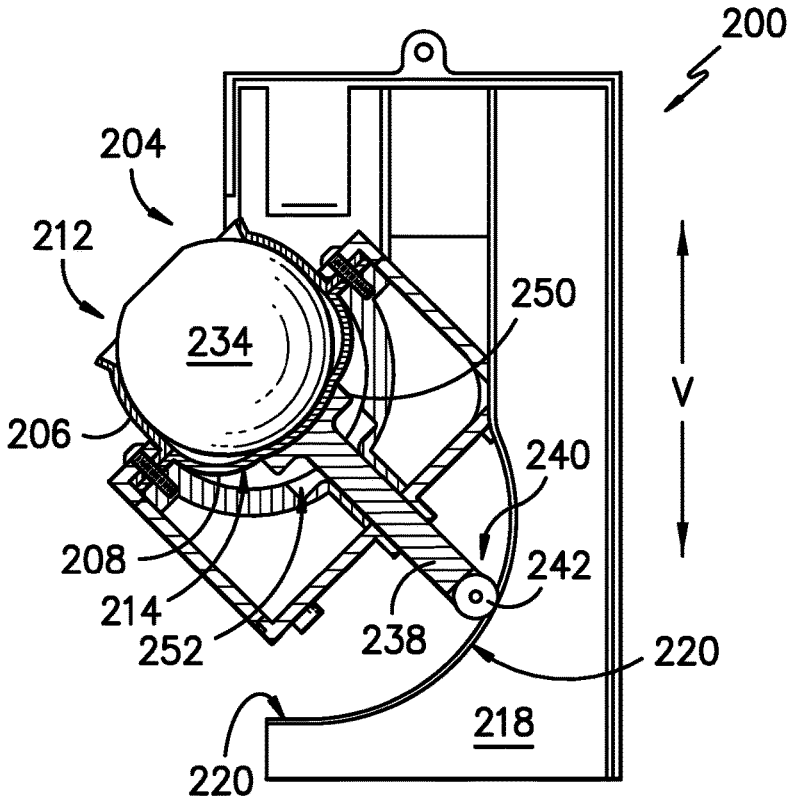
Figure 10:
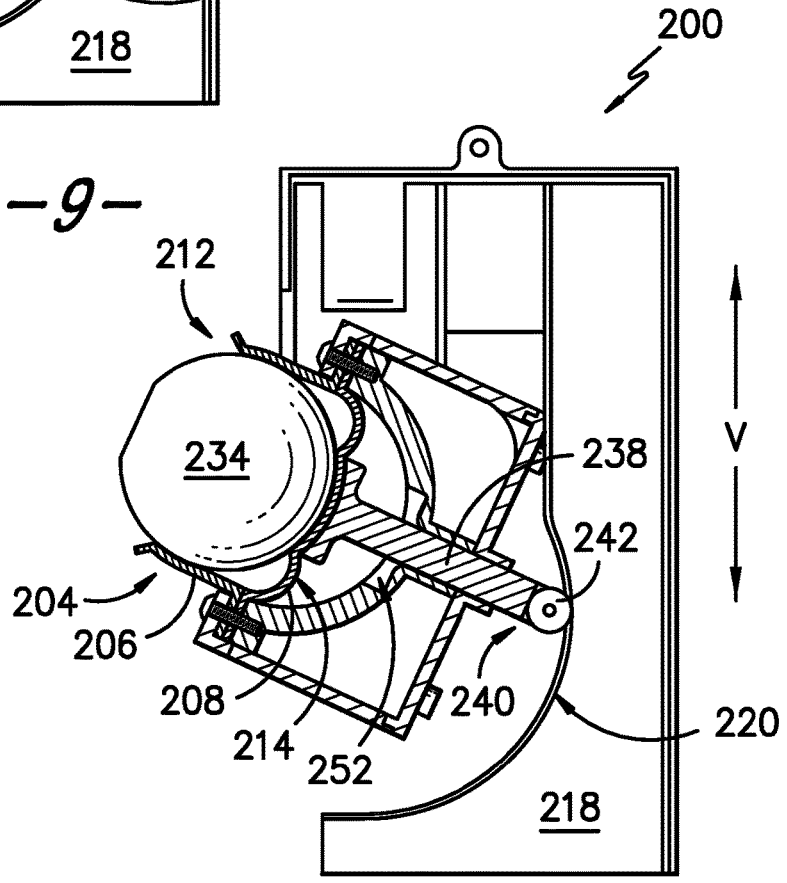

While rotation of mold 204 continues, ejector 238 moves out of a recess 252 formed in lower mold shell 209 and begins to deform flexible mold halves 206 and 208 as depicted in FIGS. 8, 9 and 10. Continued rotation increases the movement of ejector 238 and the deformation of mold halves 206 and 208. Mold half 208 even begins to invert as it is pressed towards openings 205 and 212. Ice shape 234 is also rotated but, more importantly, is forced to move in the same direction as ejector 238 by the pressing of head 250. This pressing forces ice shape 234 through opening 212. The diameter or size of opening 212 can increase due to the flexibility of mold half 206 and pleats 230 (e.g., slits) in mold half 206. As mold 204 reaches the second position shown in FIG. 11, ejector 238 reaches the extended position so as to force ice shape 234 to be fully ejected from mold 204 as shown by arrow E.

Upon reaching the second position, second limit switch 228 is activated as shown in FIG. 13, which provides a signal to controller 134 to stop motor 216. Either immediately or after a delay, controller 134 can caused motor 216 to reverse direction so that mold 204 is returned to the first position and ejector 238 is fully retracted. Upon reaching the first position, first limit switch is activated as shown in FIG. 12, which provides a signal to controller 134 to stop motor 216. Either immediately, or after a delay, controller 134 can repeat the process of refilling chamber 210 with water 236 using dispenser 232 so a to create another ice shape 234.

For the exemplary embodiment described above, ice mold 204 and ejector 238 rotate 90 degrees between the first position and the second position. In other embodiments, a different degree of rotation may be used. Additionally, gravity and/or the resiliency of lower mold half 208 may be used to return ejector 238 to the retracted position. A spring that is compressed as ejector 238 is extended could also be used to urge ejector 238 back to its retracted position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerated appliance, comprising:

a mold defining a chamber for the formation of an ice shape and an opening; the mold rotatable between a first position and a second position;

an ejector positioned adjacent to the mold and rotatable with the mold between the first position and the second position, the ejector configured to deform the mold as the ejector pushes the ice shape out of the chamber through the opening as the mold rotates between the first position and the second position; and a motor for rotating the mold and the ejector from the first position to the second position.

2. The ice making assembly of claim 1, wherein the ejector is configured to move between a retracted position and an extended position as the mold and the ejector are rotated between the first position and the second position.

3. The ice making assembly of claim 1, wherein the mold defines an external surface that is pressed by the ejector during rotation from the first position to the second position.

4. The ice making assembly of claim 1, further comprising a cam in mechanical communication with the ejector, the cam defining an arcuate path that is followed by one end of the ejector as it rotates between the first position and the second position.

5. The ice making assembly of claim 1, further comprising:

a first limit switch for stopping rotation of the mold and the ejector when the mold is moved into the first position; and a second limit switch for stopping rotation of the mold and the ejector when the mold is moved into the second position.

6. The ice making assembly of claim 1, wherein the mold comprises a flexible material.

7. The ice making assembly of claim 1, wherein the mold comprises a lower mold half and an upper mold half that together form the chamber in a spherical shape.

8. The ice making assembly of claim 7, wherein the upper mold half defines the opening and further comprising a plurality of pleats around the opening.

9. The ice making assembly of claim 8, further comprising a plurality of heat exchanging fins in thermal communication with the lower mold half.

10. The ice making assembly of claim 1, further comprising a cam in mechanical communication with the ejector, the cam defining a slotted, arcuate path for receipt of a cam follower positioned at one end of the ejector, the cam follower riding along the arcuate path as the ejector rotates between the first position and the second position.

11. A refrigerated appliance, comprising:

a cabinet including a freezer chamber;

an ice making assembly positioned in the freezer chamber, the ice making assembly comprising a a flexible mold comprising a lower mold half and an upper mold half, the mold defining a chamber for the formation of an ice shape and an opening to the chamber, the upper mold half defining the opening;

the mold configured to rotate between a first position in which the opening is oriented upwardly and a second position in which the ice shape can be ejected from the chamber; and an ejector positioned adjacent to the mold, the ejector configured to move between i) a retracted position when the flexible mold is in the first position and ii) an extended position when the flexible mold is in the second position, the ejector causing the ice shape to move through the opening of the chamber as the ejector moves from the retracted position to the extended position;

wherein the ejector deforms the lower mold half to push the ice shape through the opening as the ejector moves into the extended position.

12. The refrigerated appliance of claim 11, further comprising a cam for translating the cam from the retracted position to the extended position as the cam is rotated with the flexible mold.

13. The refrigerated appliance of claim 12, further comprising a cam follower attached with the ejector and riding upon an arcuate surface of the cam.

14. The refrigerated appliance of claim 1, further comprising:

a first limit switch for stopping rotation of the mold when such is moved into the first position; and a second limit switch for stopping rotation of the mold when such is moved into the second position.

15. The refrigerated appliance of claim 14, further comprising a water dispenser positioned over the opening when the flexible mold is in the first position.

16. The refrigerated appliance of claim 15, further comprising an ice bin for the receipt of the ice shape after ejectment from the flexible mold.

17. The refrigerated appliance of claim 16, further comprising a motor for powering movement of the flexible mold between the first position and the second position.

* * * * *